US005600307A

United States Patent [19]

Aslan

[11] Patent Number: 5,600,307

[45] Date of Patent: Feb. 4, 1997

[54] SURFACE CHARGE PERSONAL ELECTROMAGNETIC RADIATION MONITOR AND METHOD

[75] Inventor: Edward E. Aslan, Plainview, N.Y.

[73] Assignee: The Narda Microwave Corp., Hauppauge, N.Y.

[21] Appl. No.: 557,937

[22] Filed: Nov. 14, 1995

[51] Int. Cl.[6] ..... G08B 21/00

[52] U.S. Cl. ..... 340/600; 250/336.1; 250/395; 250/526

[58] Field of Search ..... 340/600; 250/336.1, 250/395, 526

[56] References Cited

U.S. PATENT DOCUMENTS

| | | | |
|---|---|---|---|
| 4,605,905 | 8/1986 | Aslan | 330/9 |
| 5,168,265 | 12/1992 | Aslan | 340/600 |
| 5,373,284 | 12/1994 | Aslan | 340/600 |
| 5,373,285 | 12/1994 | Aslan | 340/600 |

OTHER PUBLICATIONS

Vernon R. Reno, *Microwave Reflection, Diffraction and Transmission by Man*, National Technical Information Service, Department of Commerce, Feb. 1974.

Edward A. Wolff, "Antenna Analysis", John Wiley & Sons, Inc., p. 27.

Gandi, et al., "Currents Induced in a Human Being for Plane–Wave Exposure Conditions 0–50 MHZ and for RF Sealers", *IEEE Transactions on Biomedical Engineering*, vol. BME–33, No. 8, Aug. 1986.

Jordan, et al., "Electromagnetic Waves and Radiating Systems", *Radiation*, pp. 333–337.

Henryk Korniewicz, "The First Resonance of a Grounded Human Being Exposed to Electric Fields", *IEEE Transactions on Electromagnetic Compatability*, vol. 37, No. 2, May 1995.

*Primary Examiner*—Glen Swann

*Attorney, Agent, or Firm*—Hoffmann & Baron

[57] ABSTRACT

A personal electromagnetic radiation monitor includes an electromagnetic radiation sensor assembly having a surface area sensor in the form of a conductive can-shaped or boss-like element. The surface area sensor detects the radial electric field component directly from the radiating antenna or a secondary radial field component created by the displacement current induced in the wearer of the personal monitor who is illuminated by the electromagnetic radiation. The radial field component is detected by a diode detector circuit and is provided to a comparator circuit which will trigger an alarm if the induced current exceeds a predetermined level.

11 Claims, 11 Drawing Sheets

SURFACE CHARGE PERSONAL ELECTROMAGNETIC RADIATION MONITOR AND METHOD

BACKGROUND OF THE INVENTION

1. Field of the Invention

This invention relates to radiation monitors, and more specifically relates to an electromagnetic radiation monitor which may be worn by persons who may be exposed to potentially harmful levels of electromagnetic energy. Even more particularly, this invention relates to a personal electromagnetic radiation monitor for use in the RF (radio frequency) region of the frequency spectrum and which operates substantially independently of polarization.

2. Description of the Prior Art

Attempts have been made to make an electromagnetic radiation monitor which may be worn by a person working in areas where potentially harmful electromagnetic radiation may be present. Early studies, such as those reported by Beischer in his article, *Microwave Reflection, Diffraction and Transmission By Man,* Department of Naval Aerospace Medical Research Lab, Pensacola, Fla., June, 1973, have shown that scattering from a body may produce errors greater than 2 dB. This scattering becomes more significant where broadband frequency performance and independence of polarization are desired monitor characteristics.

U.S. Pat. No. 5,168,265, which issued to Edward E. Aslan, also the inventor herein, discloses a radiation monitor which is independent of polarization and preferably operable between about 2 GHz and about 18 GHz. The radiation monitor senses the electric field component of the electromagnetic radiation and employs thin film resistive theremocouples for this purpose.

To this date, no practical device being independent of polarization and being responsive to electromagnetic radiation in the RF region, this is, about 0.1 to about 110 MHz, to the knowledge of the inventor, has been successfully marketed.

OBJECTS AND SUMMARY OF THE INVENTION

It is an object of the present invention to provide an electromagnetic radiation monitor which may be worn by persons who may be exposed to potentially harmful levels of electromagnetic energy.

It is another object of the present invention to provide a personal electromagnetic radiation monitor which is responsive to electromagnetic radiation in the frequency region of about 0.1 to about 300 MHz.

It is a further object of the present invention to provide an unobtrusive, pocket-size personal electromagnetic radiation monitor which accurately detects RF radiation and sends out a warning the moment it senses that the wearer moves into a danger zone.

It is yet another object of the present invention to provide an electromagnetic radiation sensor assembly which generates a substantially flat response to sensed electromagnetic radiation over frequency.

It is yet another object of the present invention to provide a personal electromagnetic radiation monitor that generates a response that is shaped to the ANSI (American National Standards Institute) C95.1-1991 standard over the frequency band of use.

It is yet another object of the present invention to provide a personal electromagnetic radiation monitor whose response to signals above the frequency band of use is greatly reduced.

It is yet another object of the present invention to provide a personal electromagnetic radiation monitor which complies with the ANSI and IEEE (Institute of Electronic and Electrical Engineers) standards for detecting electromagnetic radiation.

It is still a further object of the present invention to provide a personal electromagnetic radiation monitor whose performance is substantially unaffected due to scattering when worn by a person.

It is another object of the present invention to provide a method for detecting the presence of harmful electromagnetic radiation.

It is yet another object of the present invention to provide a personal electromagnetic radiation monitor which is operable over a wide range of frequencies and over a wide range of distances from the source of electromagnetic radiation.

It is still another object of the present invention to define an electromagnetic radiation meter for measuring the electric field component of electromagnetic radiation or the current induced in the body of a person exposed to the electromagnetic radiation.

In accordance with one form of the present invention, a personal electromagnetic radiation monitor includes an electromagnetic radiation sensor assembly, a detector circuit coupled to the sensor assembly and associated electronic circuitry coupled to the detector circuit which will compare a signal proportional to the sensed electromagnetic radiation with a predetermined threshold and trigger an alarm to warn the wearer of exposure to a dangerous level of electromagnetic radiation.

The measurement of low frequency electric (E) fields in the presence of a human is difficult because of the perturbation caused by the human. As will become evident, this invention uses the very same mechanism for the perturbation of the field to monitor the hazard caused by the illuminating field.

The sensor assembly includes a surface area sensor which may have a planar shape or be three dimensional to provide a quasi-isotropic response. More specifically, the surface area sensor may be in the form of a conductive, or at least partially resistive, disk or plate, or a can-shaped or boss-like conductive element formed from a conductive or at least partially resistive disk and cylindrical sidewall, the sidewall extending perpendicularly from the periphery of the disk.

The surface area sensor primarily responds to the electric field's radial component. As will be explained in greater detail, the radial field is the major energy component of the electromagnetic field in the lower RF frequency region, and decreases in magnitude with increasing distance (in terms of wavelength) from the source of the illuminating field, i.e., the radiating antenna.

For example, within the AM (amplitude modulated) broadcast band, i.e., about 500 KHz to about 1.5 MHz, the radial field component remains significant to about 100 meters and about 33 meters, respectively, from the radiating antenna. Beyond these distances, the radial field looses strength and the vertical or horizontal field becomes the major energy component of the electromagnetic field. At low frequencies and at close distances to the radiating antenna, the radial field from the antenna induces a surface charge on the sensor, which results in a displacement current which is measured and compared to a preset threshold value, above which is considered dangerous and which will trigger the alarm, alerting the wearer of the personal monitor.

In accordance with the present invention, the personal monitor still responds to hazard conditions at higher frequencies and at farther distances from the radiating antenna, where the radial component is not as prominent. If the vertical or horizontal E field, which becomes significant at the higher frequencies and greater distances from the radiating antenna, illuminates the person wearing the monitor, the field will induce a current in the person which, in turn, will create a secondary radial E field close to the surface of that person. The surface area sensor will sense this secondary radial E field and cause the personal monitor to respond appropriately.

These and other objects, features and advantages of the present invention will become apparent from the following detailed description of illustrative embodiments thereof, which is to be read in conjunction with the accompanying drawings.

DETAILED DESCRIPTION OF THE PREFERRED EMBODIMENTS

Figure 1:
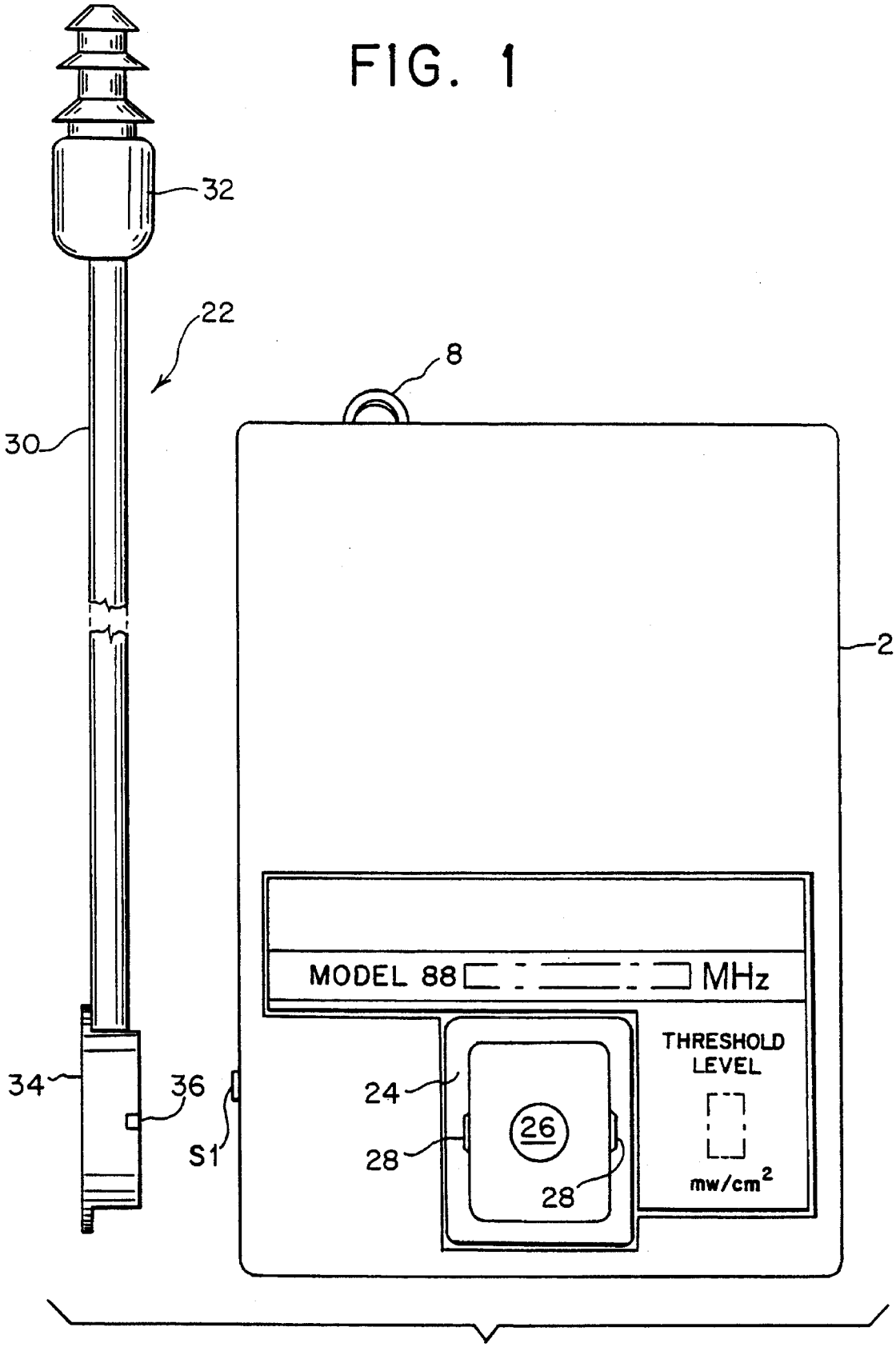
FIG. 1 is a front view of a personal electromagnetic radiation monitor formed in accordance with the present invention.
Figure 3:
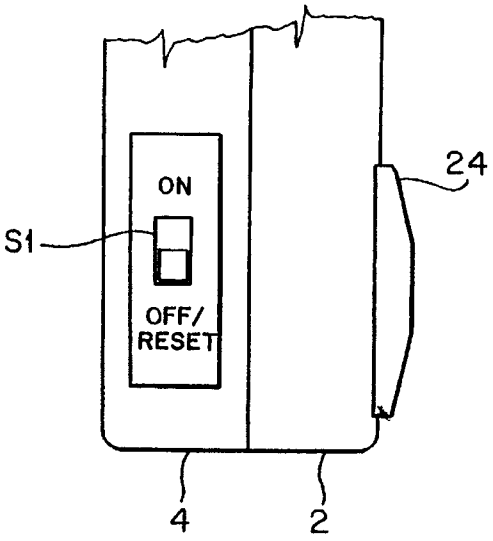
FIG. 3 is a side view of a portion of the radiation monitor of the present invention.

Referring initially to FIGS. 1–4 of the drawings, it will be seen that a personal electromagnetic radiation monitor constructed in accordance with one form of the present invention includes a two-piece housing having a front half 2 and a back half 4 which are mateable together. The front half 2 of the housing has mounted on it an audible alarm transducer 6, such a piezo ceramic transducer, which, as will be explained, provides a warning of high level RF radiation or that the battery used in the monitor is at a low voltage. During an initial turn-on test, the audible alarm 6 preferably provides a one second sound burst. Above a preset threshold of the detected RF energy, the alarm 6 provides a periodic nominal one second sound burst with the repetition rate increasing with the level of exposure. When the monitor battery is at a low voltage, the alarm provides an audible chirp every 40 seconds to a continuous warble (as the battery voltage drops). If the battery voltage is so low that the electromagnetic radiation sensor used in the monitor fails, the audible alarm 6 provides a continuous tone.

The personal electromagnetic radiation monitor of the present invention further includes a visual display in the form of a light emitting diode (LED) 8. The LED 8 is mounted on the upper wall of the back housing half 4. During an initial turn-on test, the circuitry included in the monitor will illuminate the LED. When a predetermined amount of RF energy is detected by the monitor, the electronic circuitry will cause the LED 8 to light and the audible alarm 6 to beep, indicating a need for the wearer of the monitor to leave the area promptly.

The monitor further includes an on/off switch S1 mounted on a side wall of the back half 4 of the housing, as well as a resilient clip 10 mounted on the back half of the housing to allow the monitor to be carried by the wearer on his belt or shirt pocket.

Figure 2:
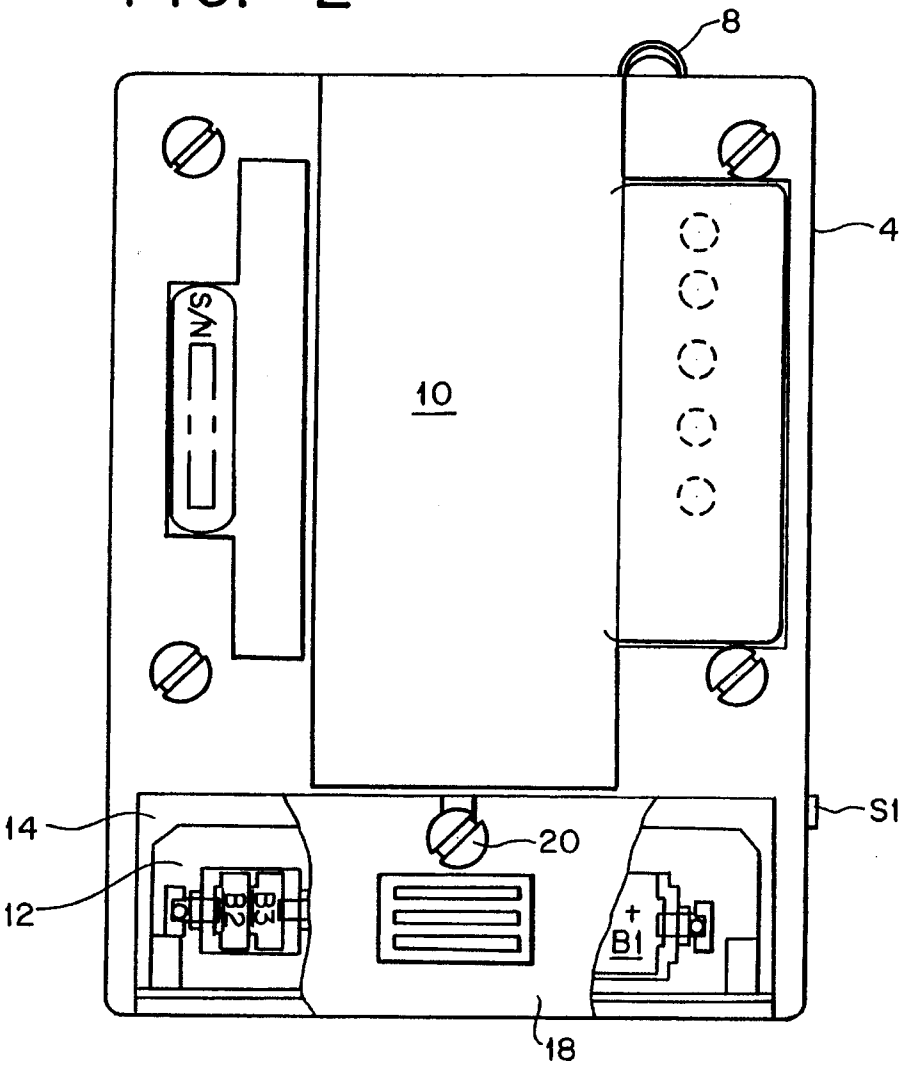
FIG. 2 is a rear view of the radiation monitor of the present invention, showing the battery compartment cover partially broken away.
Figure 4:
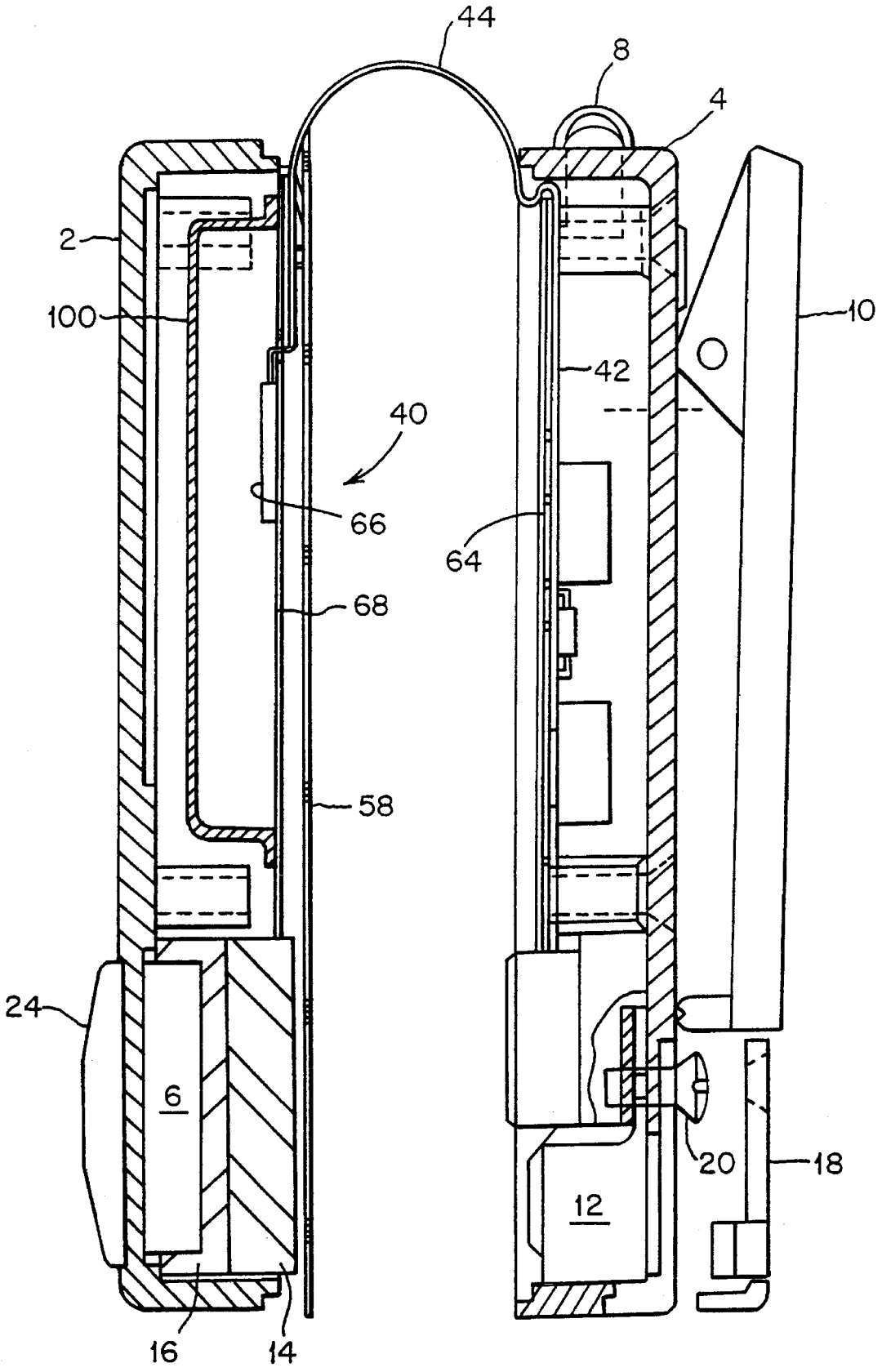
FIG. 4 is a partially exploded side view of the monitor shown in FIG. 1, formed in accordance with one form of the present invention.

As shown in FIGS. 2 and 4 of the drawings, the mated housing halves define a battery compartment 12 which houses a 12 volt alkaline battery B1 and two 1.5 volt button batteries B2, B3 connected in series. To insure that no RF energy affects the performance of the monitor, the battery compartment 12 which houses batteries B1–B3 is at least partially lined with a lossy material 14 so that the batteries are at least partially surrounded by the material, and the transducer 6, as well, is at least partially surrounded by an absorbent or lossy material 16. The battery compartment 12 has an opening formed in the back housing half 4, which opening is covered by a battery compartment cover 18, which cover is held in place by a screw 20.

The radiation monitor of the present invention also includes an ear plug assembly 22, as shown in FIG. 1 of the drawings, so that the monitor may be used in high noise environments. A multi-sided wall 24 extends outwardly from the outside surface of the front housing half 2 and situated to surround an opening 26 formed in the front wall of the housing half and aligned with the transducer 6. The wall 24 includes one or more detents 28 formed in its inner surface. The ear plug assembly 22 includes an elongated hollow tube 30. A pneumatic ear piece or ear plug 32 is mounted on one end of the tube 30, and a hollow housing 34 defining an interior cavity is mounted on the other end. The hollow housing 34 has an opening formed through its thickness, and includes one or more outwardly extending protrusions 36 which are adapted to mate with the detents 28 formed in the wall 24 of the monitor housing to hold the ear plug housing in place when it is received within the interior area defined by the multi-sided wall 24. This will allow the ear plug housing 34 to be mounted adjacent to the transducer 6 so that the tone emitted by the transducer will be carried by air pressure through the tube to the pneumatic ear plug 32.

Another suitable ear plug which may be used in conjunction with the personal radiation monitor of the present invention is disclosed in U.S. Pat. No. 5,168,265, which issued to Edward E. Aslan, the inventor herein, the disclosure of which is incorporated herein by reference.

The ear plug assembly 22 is advantageous in that it is completely electrically non-conductive. Therefore, the ear plug assembly will not pick up RF energy which might have otherwise affected the electronic circuitry of the monitor, as a conventional electrical transducer would, and further provides a safety feature in that the user of the monitor does not wear an electrically conductive device on his head, to prevent electrical shock and to prevent RF energy from being picked up by the ear plug assembly 22 and being radiated to the wearer's head.

Figure 17:
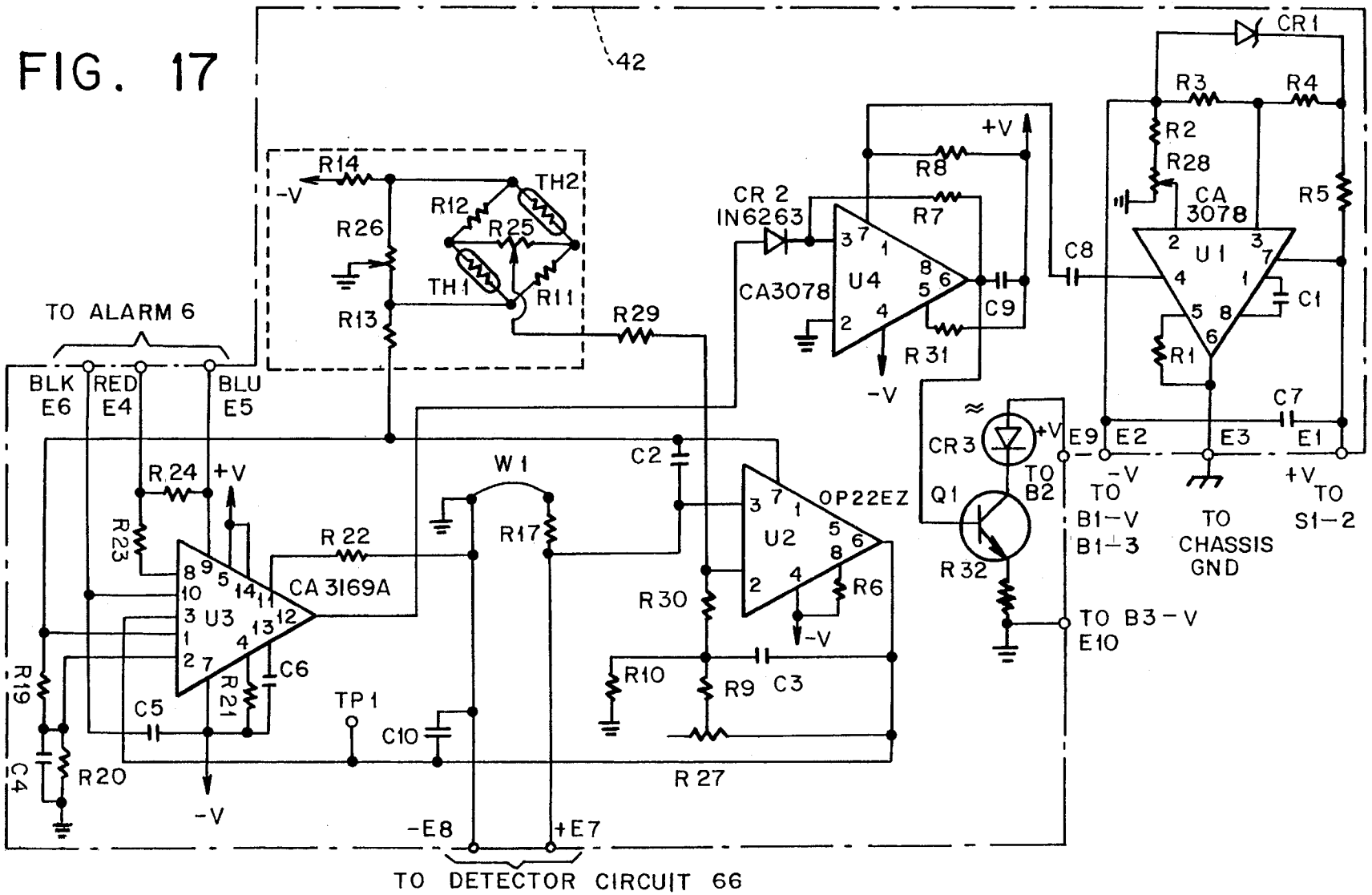
FIG. 17 is a schematic diagram of another portion of an electronic circuit used in conjunction with the monitor of the present invention.

Referring now to FIG. 4 of the drawings, it will be seen that the personal radiation monitor of the present invention includes an electromagnetic radiation sensor assembly 40 situated in the front half 2 of the housing, and a main printed circuit board 42 containing the electronic circuitry for the monitor situated in the back half 4 of the housing. The sensor assembly 40, which preferably has mounted with it the detector circuitry 66 shown in FIG. 12, as will be described, is electrically coupled to the electronic circuitry of the main printed circuit board 42, which electronic circuitry is shown in FIG. 17, by a flexible transmission line 44 consisting of at least one resistive lead mounted on a Mylar(™) tape to provide strength. The lead has a resistance of approximately 5K ohms per square with a nominal resistance of 250K ohms. Transmission line 44 may include a ground lead (not shown) running parallel with the resistive lead to provide a common ground between the detector circuit and the electronic circuitry on the main printed circuit board 42.

The electromagnetic radiation sensor assembly 40 includes a surface area sensor 100 having a planar shape. Alternatively, the surface area sensor 100 may be three dimensional in shape, allowing for a quasi-isotropic response to electromagnetic radiation.

Figure 9:
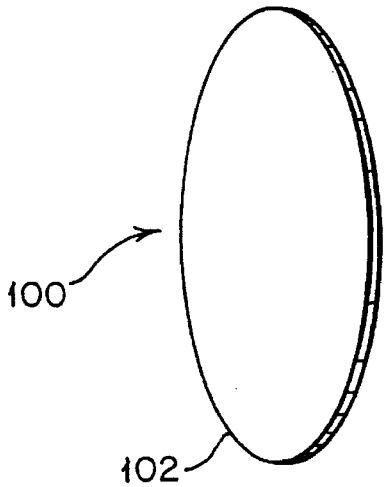
FIG. 9 is a perspective view of a portion of the sensor assembly of the radiation monitor formed in accordance with a second embodiment of the present invention.

More specifically, and as shown in FIG. 9, the surface area sensor 100 may be in the form of a flat conductive member, such as a disk or plate 102, which is mounted in one half of the monitor housing and which is connected to associated circuitry through the flexible transmission line 44. This form of a surface area sensor, as will be explained in greater detail, allows the personal monitor of the present invention to respond primarily to the radial field component of the electromagnetic radiation. The sensor assembly having such a conductive disk surface area sensor 100 provides a flat response over the desired band of use. A resistor, such as resistor R3 shown in FIG. 12, may be connected in series with the conductive disk sensor 100 to attenuate the higher frequency components or aid in shaping the response of the radiation sensor.

Figure 10:
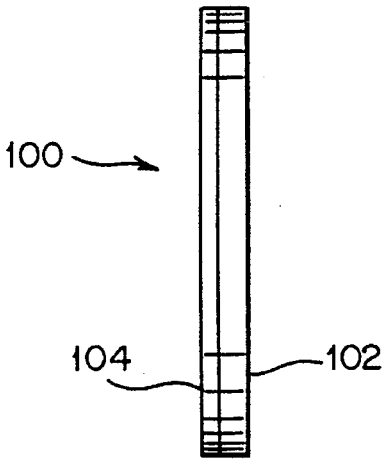
FIG. 10 is a side view of a portion of the sensor assembly of the radiation monitor formed in accordance with a third embodiment of the present invention.

Alternatively, and as shown in FIG. 10 of the drawings, the disk or plate surface area sensor 100 may be at least partially resistive by including a resistive film 104 affixed to at least one surface of the disk 102. This resistive disk sensor also responds to radial field components of the electromagnetic radiation, and may be used in the personal monitor to shape the response of the sensor or reduce the higher frequency out-of-band components.

Figure 7:
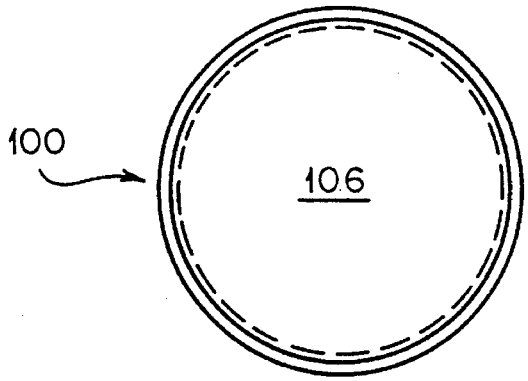
FIG. 7 is a front view of a portion of the sensor assembly formed in accordance with one form of the present invention.
Figure 8:
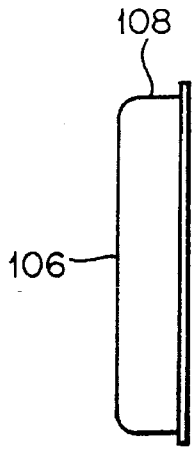
FIG. 8 is a side view of the portion of the sensor assembly shown in FIG. 7.

In a third embodiment, and as shown in FIGS. 7 and 8, the surface area sensor 100 may be a can-shaped or boss-like conductive element formed from a conductive (or at least partially resistive) disk 106 and a conductive (or at least partially resistive) cylindrical sidewall 108 extending perpendicularly from the periphery of the disk 106. This embodiment of the surface area sensor 100 may be realized with a can-shaped plastic form to act as a substrate to support a metallic coating, such as a silver epoxy.

By adding a third dimension, i.e., the sidewall 108, to the conductive disk 106, the surface area sensor 100 will respond to vertical (or horizontal) or radially polarized fields. It is also envisioned to be within the scope of this invention to include a three dimensional surface area sensor in the form of a sphere or hemisphere.

Figure 6:
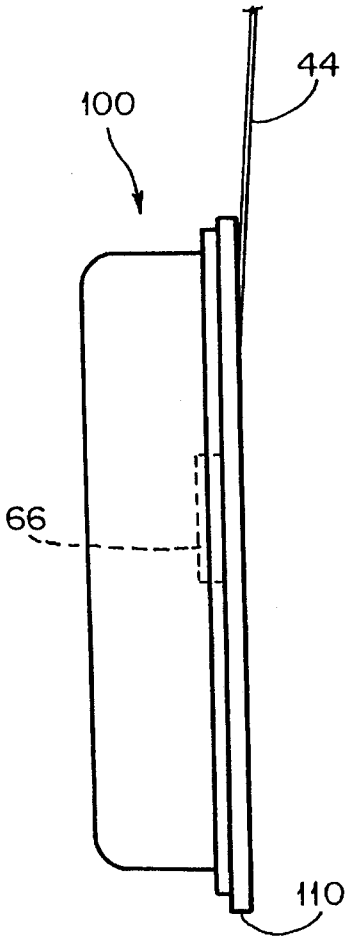
FIG. 6 is a side view of the portion of the radiation monitor shown in FIG. 5.
Figure 5:
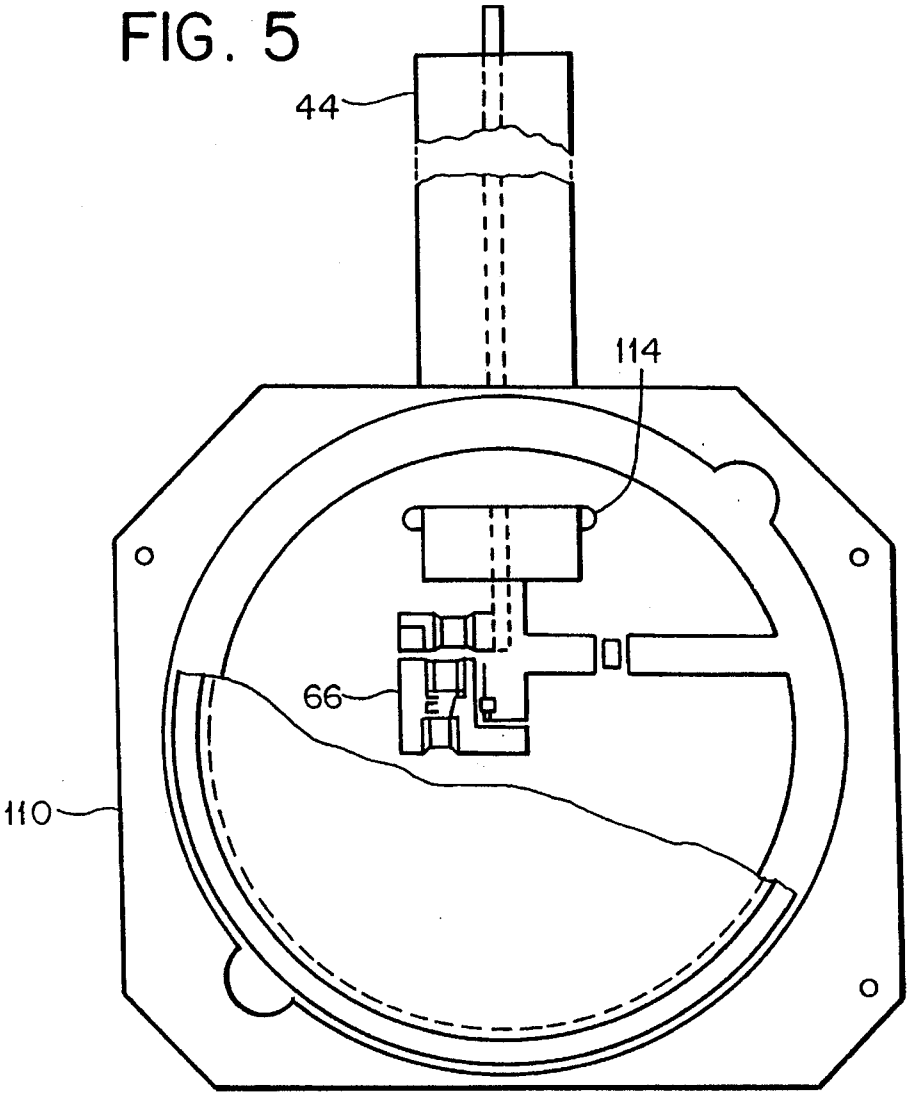
FIG. 5 is a front view of a portion of the radiation monitor shown in FIG. 4.

The surface area sensor 100 is mounted on the top side of a printed circuit board 110, as is shown in FIGS. 5 and 6, and secured to the front half 2 of the monitor housing, as shown in FIG. 4. Returning again to FIG. 4 of the drawings, the monitor includes a first insulator sheet 64, such as formed from a sheet of Mylar (™) material, situated adjacent to the bottom side of the main printed circuit board 42. A ground shield 58 preferably made of a conductive material and formed as a metal plate or foil, such as from aluminum, is positioned adjacent to the first insulator 64 and thus sandwiched between the main circuit board 42 and the printed circuit board 110 on which the surface area sensor is mounted.

The printed circuit board 110 on which the surface area sensor 100 is mounted may include the detector circuit 66, as will be described in greater detail, to which the sensor is electrically connected. The detector circuit 66 is advantageously mounted on the same printed circuit board 110 as that of the surface area sensor in order to be as close as possible (to minimize detecting noise) to the sensor and within the interior space defined by the can-shaped sensor which is preferably used so as to not take up any additional space within the monitor housing. The detector circuit 66 is connected to the flexible transmission line 44, which passes through a slot 114 formed through the thickness of the printed circuit board 110, and is thus electrically coupled to the electronic circuitry of the main printed circuit board 42 mounted in the back half 4 of the monitor housing (FIG. 4).

The sensor assembly 100 of the present invention differs in structure and function from those of the inventor's personal electromagnetic radiation monitors disclosed in U.S. Pat. Nos. 5,168,265, 5,373,284 and 5,373,285, the disclosures of which are incorporated herein by reference. U.S. Pat. No. 5,168,265 describes a personal radiation monitor which senses the electric field component of the electromagnetic radiation and employs thin film resistive thermocouples for this purpose. The personal radiation monitor described in the '265 patent responds to frequencies between about 2 GHz and about 18 GHz.

U.S. Pat. Nos. 5,373,284 and 5,373,285 disclose radiation monitors which employ perpendicular coils or loops as the sensor. The radiation monitors described in the '284 and '285 patents are capable of monitoring electromagnetic radiation in the frequency range of between about 30 MHz and about 1000 MHz. Effectively, the magnetic field component of the radiation is monitored below a transition point, which occurs about 200 MHz, and the electric field component is monitored above the transition point.

The particular structure of the sensor assembly 100 of the personal monitor described herein permits sensing of the electric field component in the lower RF frequency region of about 0.5 MHz to about 1.5 MHz, which covers the AM (amplitude modulated) broadcast band, or alternatively up to about 300 MHz. One of the problems with measuring low frequency electric (E) fields in the presence of a human is the perturbation of the field caused by the human. The present invention uses this phenomenon advantageously to monitor the hazard caused by the illuminating field.

The electric field of the electromagnetic radiation may be described as comprising a radial component situated in a radial direction from the radiating antenna, and a vertical or horizontal component situated perpendicularly or orthogonally with respect to the radial field component. In many situations, the radiating antenna is a vertically disposed monopole antenna, especially those used for radio broadcasting, and the electric field of the radiated signal would comprise a radial and vertical component, "vertical" in the sense that it is parallel to the length of the radiating antenna. In the region close to the radiating antenna, the major energy component of the electromagnetic field is radial.

The radial fields exist for approximately ⅙ of a wavelength. Therefore, for the AM broadcast band of between about 500 KHz and about 1.5 MHz, the radial field component exists from between 100 meters and 33 meters, respectively, from the antenna. At this distance, the strength of the radial field component is substantially equal to that of the vertical field component. This principle is discussed in the publication, *Antenna Analysis,* by Edward A. Wolff, published by John Wiley and Sons, Inc., at page 27.

With this radial E field normal to a conductive surface, such as the surface area sensor 100 of the present invention, a surface charge is induced on the conductive surface which is similar to that which produces a displacement current and is given by the equation:

$$I=\epsilon_o(A\ dE/dt)$$

where

A=surface area of the conductive surface, $\epsilon_o$=permitivity of free space, $8.85\times10^{12}$, and E=field strength in volts/meter.

At higher frequencies, the radial component of the electric field is not as prominent at a given distance from the radiating antenna, as mentioned previously. However, the personal monitor of the present invention still responds to a hazard condition. If a vertical or horizontal E field illuminates a person, it will induce a current in the person which has been found to create a measurable, secondary radial E field close to the surface of that person, which is where the personal monitor is worn, producing a response from the personal monitor. Thus, the sensor used in the personal monitor of the present invention will either respond to the primary radial E field radiating directly from the antenna or the secondary radial E field created by the induced current in the person illuminated by the vertical or horizontal E field. An analysis showing the detection of the secondary radial E field created by the induced current in a person for hazard warning purposes is described below.

It is known that the current distribution in a person illuminated by an E field is substantially sinusoidal, as shown in FIG. 5 of the article, *Currents Induced In A Human Being For Plane-wave Exposure Conditions* 0–50 *MHz And For RF Sealers,* by Om P. Gandhi, published in IEEE Transactions on Biomedical Engineering, Vol. BME-33, No. 8, August, 1986. The human body, in the presence of an illuminating field, acts as a radiating antenna and creates a secondary radial E field near the surface of the body of the human. Assuming a sinusoidal distribution of current through the human, the equation for determining the radial E field close to the surface of the body (or, for that matter, any radiating antenna having a sinusoidal current distribution) reduces to:

$$E_y=\frac{J30Im}{y}\left((Z-\mathrm{H})\frac{e^{-jBR1}}{R1}+(Z+H)\frac{e^{jR2}}{R2}-2Z\cos BH\frac{e^{-jr}}{r}\right)$$

where $E_y$=Radial electric field near the antenna,

Im=Maximum current amplitude,

H=Element length, $$B=2\frac{\pi}{\lambda},$$

J=√-1, and

λ=wavelength.

This equation comes from the publication, *Electromagnetic Waves and Radiating Systems,* by Edward C. Jordan and Keith G. Balmain, Second Edition, published by Prentice-Hall, Inc., page 336.

FIG. 10-9 of the Jordan et al. publication, on page 334 thereof, shows the geometry for fields near an antenna. This figure has been modified, as shown in FIG. 16, for the purpose of showing the calculations associated with determining the radial electric field emanating from an illuminated human body.

Figure 16:
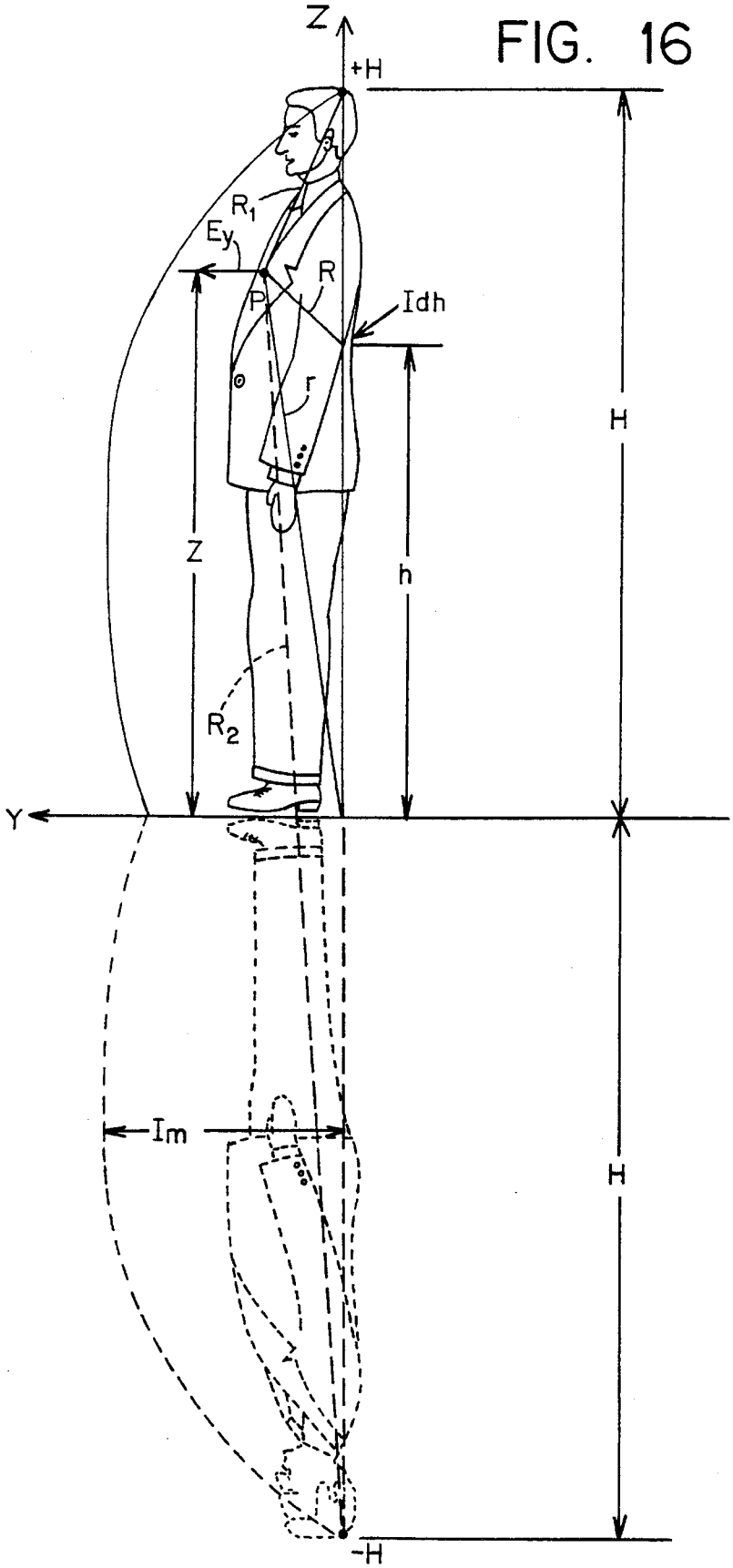
FIG. 16 is a pictorial representation of a human wearing the personal monitor of the present invention and depicting the calculations associated with determining the electric field radiated by the human exposed to electromagnetic radiation.

Referring to FIG. 16 and applying the equation described above to determine the secondary radial electric field, $E_y$, near the surface of a human body, it will be seen that the maximum current amplitude, Im, is that which occurs at the feet of the human; the element length, H, represents the height of the standard man, which is 175 cm; the variable y is the distance from the center of the person (which coincides with the Z axis) to the sensor 100 (located at point P), which is estimated to be about 25 cm; the variable z relates to the height above ground where the personal monitor is located, which is approximately 1.3 meters distance from the floor to where the sensor is on the person; the variable R1 is the distance from the top surface of the head of the person wearing the monitor to where the sensor is located, which is estimated to be about 0.515 meters; the variable R is the distance from the feet of the human to where the sensor is located, which is about 1.32 meters; and the variable R2 is the distance from where the sensor is located to the image of the top surface of the head of the person, and is estimated to be about 3.06 meters.

Accordingly, from this analysis, the radial electric field created by the current induced in a person wearing the monitor and exposed to electromagnetic radiation may be calculated.

The current, including the maximum current, Im, induced in a human being is described in the article, *The First Resonance of a Grounded Human Being Exposed to Electric Fields,* by Henryk Korniewicz, published in IEEE Transactions on Electromagnetic Compatability, Vol. 37, No. 2, May, 1995, and in particular in Equation 32 at page 298 thereof. The previously mentioned article by Om Gandhi et al. describes, and shows in particular in FIG. 2 thereof, the effect on the induced current by the subject wearing shoes versus frequency. Based on the information provided in the two above-mentioned articles, graphs of the ratio of the resultant radial field to the illuminating parallel (i.e., vertical or horizontal) field for a person wearing shoes, versus frequency, are shown in FIGS. 13 and 14, FIG. 14 being an enlarged portion of the graph shown in FIG. 13 and depicting the FM broadcast band.

Figure 13:
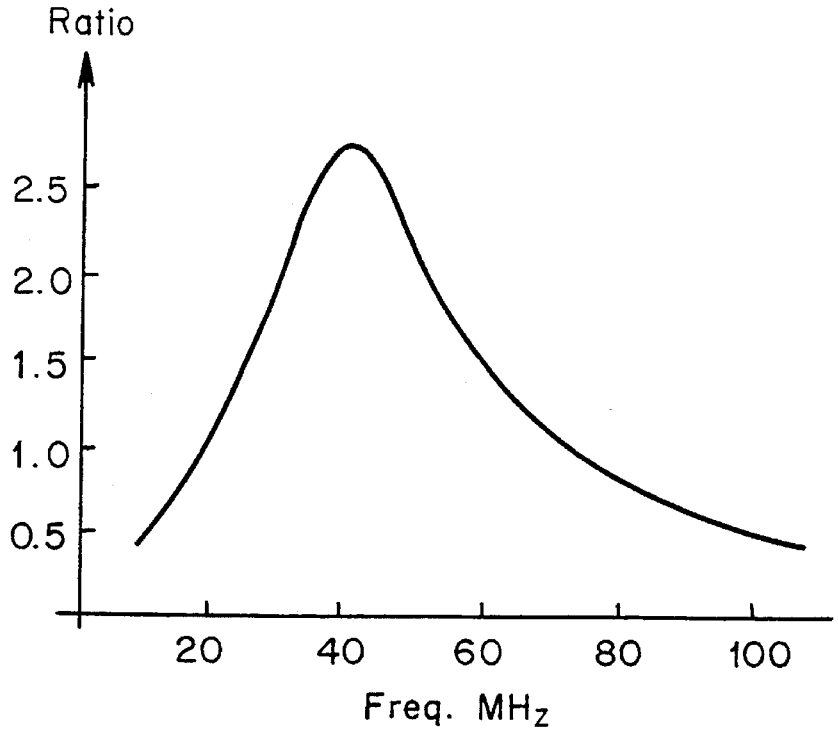
FIG. 13 is a graph of the ratio of the resultant radial field to an illuminating vertical or horizontal field in field strength (V/m) versus frequency for a human illuminated by electromagnetic radiation.
Figure 14:
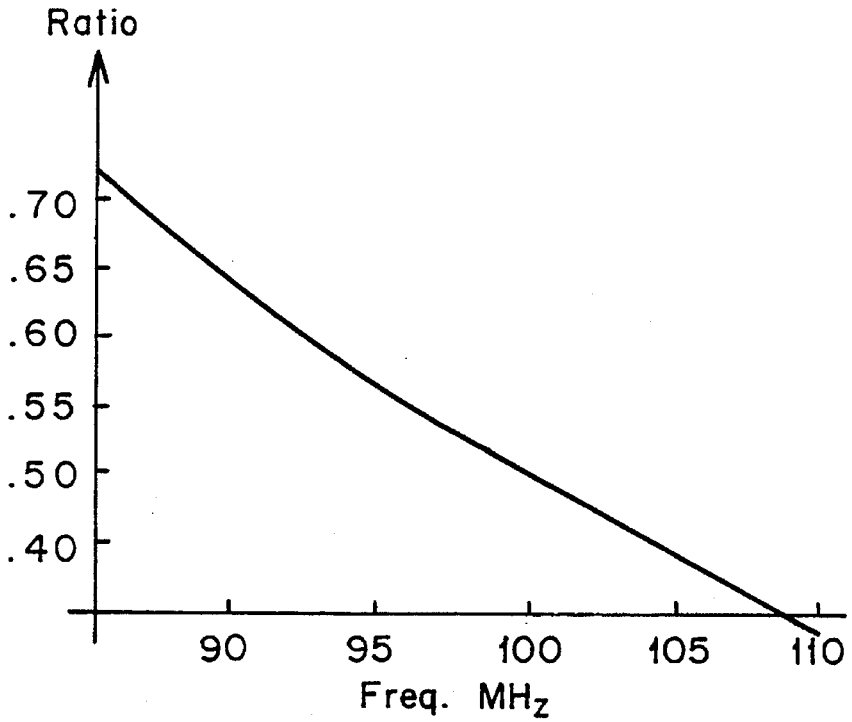
FIG. 14 is a graph of the field strength ratio versus frequency shown in FIG. 13 and depicting an enlarged portion of the graph of FIG. 13, i.e., the FM (frequency modulated) broadcast band.

As can be seen from FIGS. 13 and 14, human resonance occurs at about 40 MHz. It should be noted that at this frequency, the radial field is more than 2.5 times greater than the illuminating vertical or horizontal field and thus may be detected. It should also be noted that the radial field is significant and equal to the illuminating vertical or horizontal field over a wide frequency range from about 20 MHz to about 85 MHz.

In summary, secondary radial fields at the surface of the person's body who is wearing the personal monitor of the present invention do indeed exist and may be sensed to determine a hazard condition.

As mentioned previously and as shown in FIG. 5 of the drawings, the surface area sensor 100 of the sensor assembly 40 is connected to a detector circuit 66. The detector circuit is preferably formed as a hybrid circuit, where the individual components are dice, and the circuit is mounted on the same printed circuit board 110 to which the surface area sensor is affixed.

Figure 11:
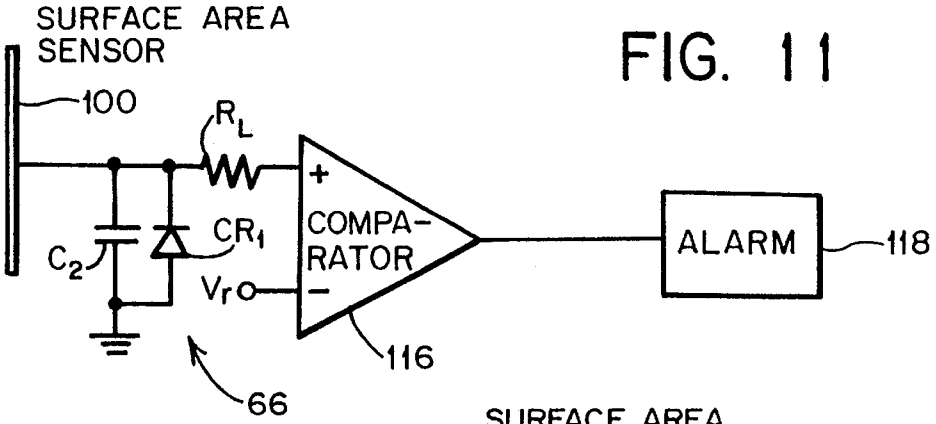
FIG. 11 is a simplified schematic diagram of a portion of the circuit of the personal monitor formed in accordance with one form of the present invention.
Figure 12:
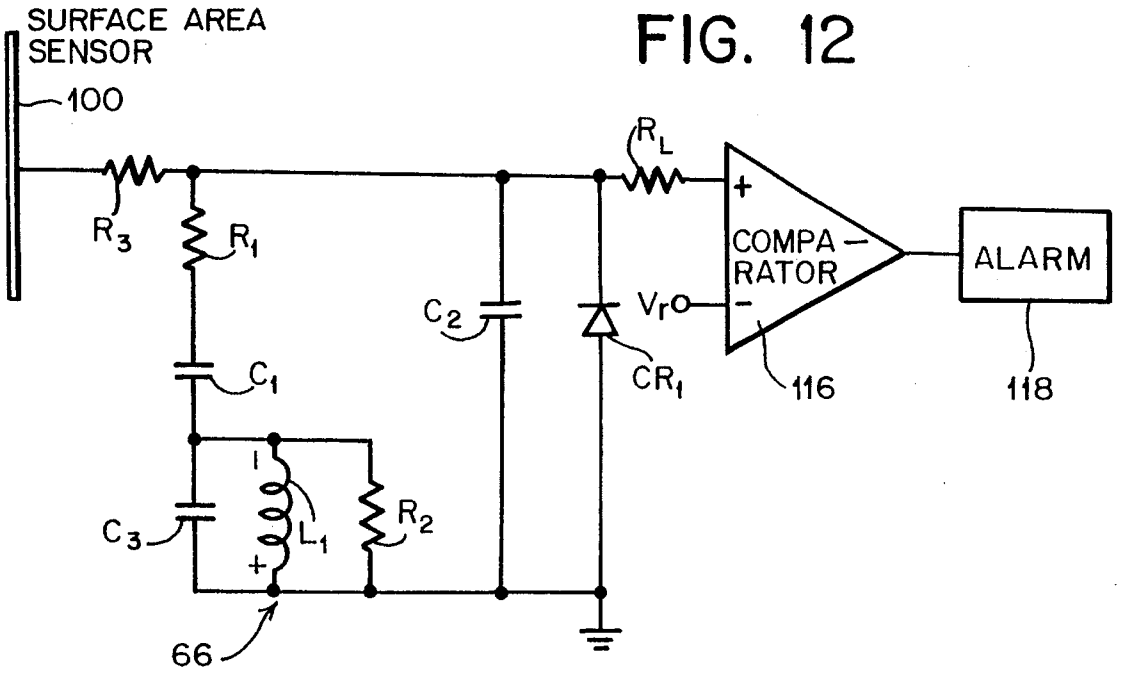
FIG. 12 is a simplified schematic diagram of a portion of the circuit of the personal monitor formed in accordance with another form of the present invention.

In its more basic form, the detector circuit 66 includes a diode CR1, as shown in FIGS. 11 and 12, which is coupled to the surface area sensor 100 and senses the current produced by the radial field on the sensor and, in turn, generates a DC (direct current) output voltage signal that is proportional to the square of the detected electric field.

The surface area sensor 100 behaves as a capacitor, the impedance, Z, of which is inversely proportional to frequency and, thus, inversely proportional to dE/dt. (The magnitude of dE/dt increases with frequency as does displacement current I. The RF detector voltage is approximately equal to I×Z.) The result is that the output signal of the detector diode CR1 is independent of frequency over a large frequency range, such as about 500 KHz to about 1.5 MHz, which includes the intended frequency range (500 KHz to 1.5 MHz) of usage for the personal monitor.

As shown in FIG. 11, a capacitor C2 may be added in parallel with the detector diode CR1 between the surface area sensor 100 and ground, and forms a capacitor divider network with the capacitance of the surface area sensor. This capacitor C2 is added in order to adjust the sensitivity of the detector diode output signal. The capacitor C2 acts to flatten the response of the sensor. In effect, the capacitor C2 and the capacitance of the sensor together become a frequency independent attenuator.

In a preferred form of the invention, and as shown in FIG. 12 of the drawings, the detector circuit 66 includes an ANSI shaping circuit so that the response of the personal monitor is made to mirror the ANSI or IEEE standard C95.1-1992. The response of the monitor in accordance with the ANSI standard is illustrated by FIG. 15 of the drawings, and this response is provided by the particular components and their values respectively set forth in FIG. 12 and the Parts List which will follow.

More specifically, the ANSI shaping circuit of the detector circuit includes a resistor R3 which is coupled to the surface area sensor 100 and which may be in the form of a discrete resistor or the intrinsic resistance of the surface area sensor itself. The other end of resistor R3 is coupled to the series connection of resistor R1, capacitor C1 and the parallel arrangement of capacitor C3, inductor L1 and resistor R2. The other end of this parallel arrangement is coupled to ground.

The series arrangement of resistor R1, capacitor C1 and the parallel arrangement of capacitor C3, inductor L1 and resistor R2 is coupled in parallel with capacitor C2 and across detector diode CR1, whose anode is grounded and whose cathode is connected to one end of resistor R3.

Figure 15:
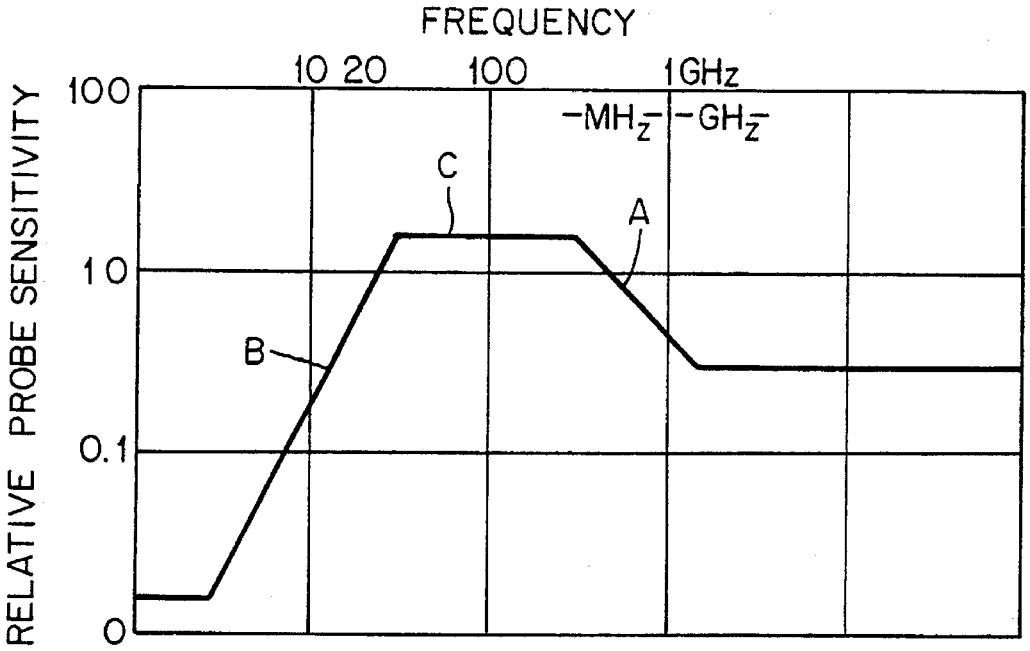
FIG. 15 is a graph plotting relative sensitivity as a function of frequency of a personal monitor formed in accordance with the present invention, the frequency scale being logarithmically presented.

Resistor R3, which as mentioned previously may also be the sensor resistance, provides the roll off in the frequency response of the monitor above approximately 300 MHz, as shown in FIG. 15 and designated by reference letter A. The combination of resistor R1, capacitor C1 and the parallel arrangement of capacitor C3, inductor L1 and resistor R2 provides the lower frequency end roll off below 30 MHz shown in FIG. 15 and designated by reference letter B. Capacitor C2 across detector diode CR1 provides the flattened response between 30 MHz and 300 MHz shown in FIG. 15 and designated by reference letter C. The flat response below 3 MHz is determined by capacitor C1.

As mentioned previously, the detector circuit 66 of the personal monitor is mounted on a printed circuit board 68 in the front half 2 of the housing and is connected to the rest of the electronic circuitry on the main printed circuit board 42 mounted in the rear half 4 of the housing through the flexible transmission line 44. In a very basic form shown in FIGS. 11 and 12, the electronic circuitry to which the detector circuit and sensor are connected may comprise a comparator circuit 116. The comparator circuit 116 is responsive to the detector circuit's output signal, or a signal corresponding to the output signal such as an amplified version of the signal.

More specifically, the comparator circuit 116 has one of its inputs, such as the non-inverting input, coupled to the detector circuit 66 through the resistive flexible transmission line 44 (shown as a resistance R2 in FIGS. 11 and 12) and has its other input, such as its inverting input, coupled to a preselected or adjustable reference voltage Vr (which is preferably ground). When the detector circuit 66 senses an induced current on the surface area sensor 100, it will provide a corresponding voltage to the non-inverting input of the comparator circuit 116. If this voltage exceeds the reference voltage Vr on the inverting input of the comparator circuit 116, an output signal provided on the output of the comparator circuit will change state. The output of the comparator circuit is provided to an alarm circuit 118, which will be triggered when the voltage on the non-inverting input of the comparator circuit 116 exceeds the reference voltage Vr on the inverting input and the output signal changes state. The alarm 118 will warn the wearer of a hazard condition and his possible exposure to dangerous electromagnetic radiation.

Figure 12A:
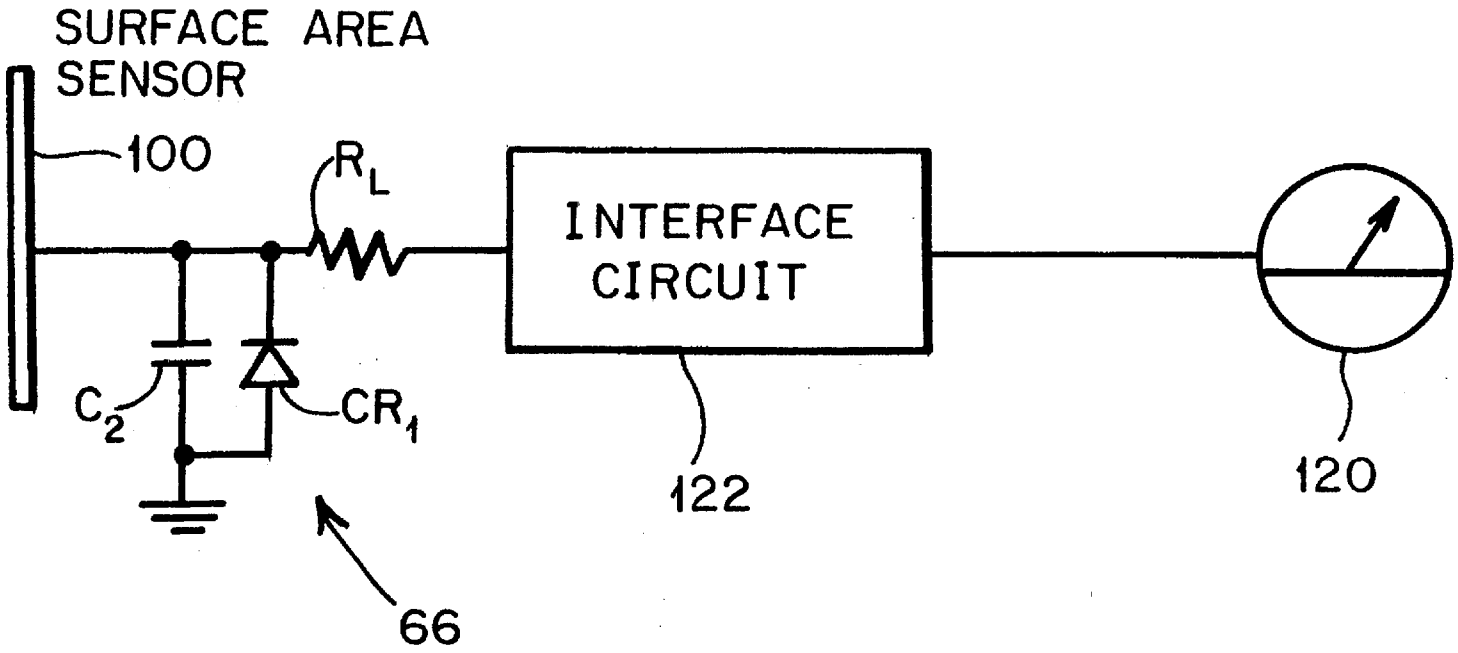
FIG. 12A is a simplified schematic diagram of a circuit for an electromagnetic radiation meter formed in accordance with the present invention.

It is envisioned to be within the scope of this invention to use electromagnetic radiation sensors and detector circuits shown in FIGS. 5–12 and described previously in constructing an electromagnetic radiation meter, as opposed to a monitor. Such a meter, formed in accordance with the present invention, is shown in FIG. 12A. The sensor 100 is coupled to the detector circuit 66, as previously described, and the output signal from the detector circuit 66 drives an indicator 120, such as an analog or digital meter, either directly or through an appropriate interface circuit 122, such as an amplifier, which is interposed between the detector circuit 66 and the indicator 120 to transform the output signal of the detector circuit into a signal appropriate for driving the indicator. The indicator 120 will provide to the user of the meter a measurement of the signal strength of the electromagnetic radiation in the area of the meter or, alternatively, a measurement of the current induced in the body of the person carrying the meter.

Figure 18:
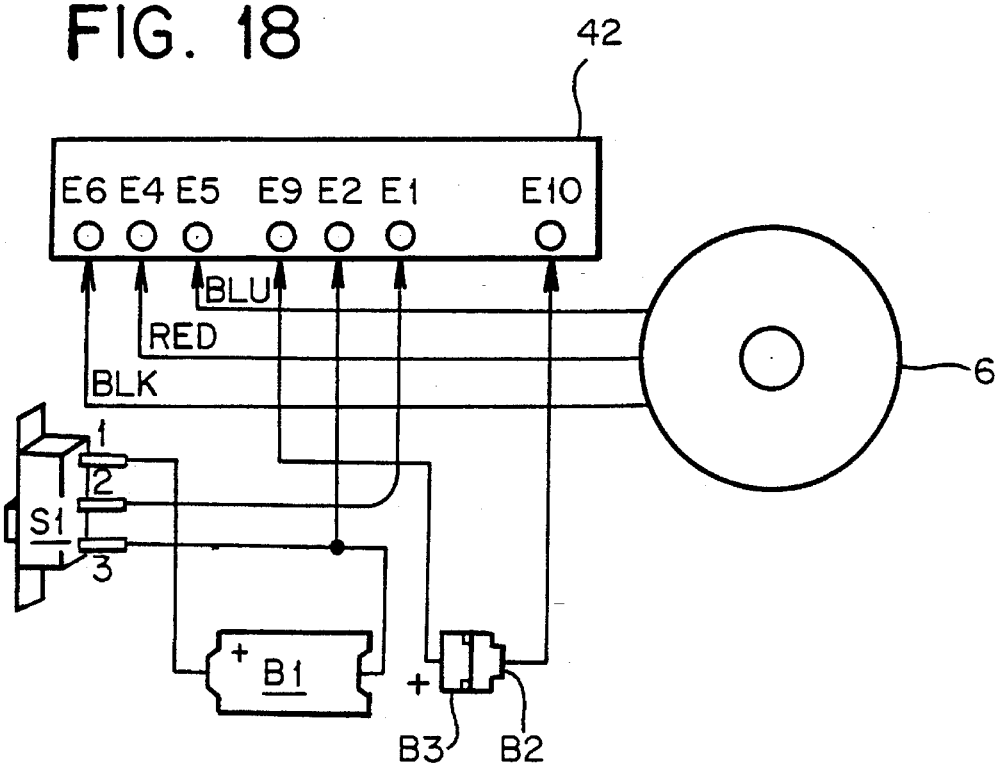
FIG. 18 is a schematic/pictorial diagram of another portion of the electronic circuit used in conjunction with the monitor of the present invention.

A preferred form of the electronic circuitry on the main printed circuit board 42 to which the detector circuit 66 is connected is shown in FIGS. 17 and 18 of the drawings. This circuit is the same as or similar to the circuit illustrated in U.S. Pat. Nos. 5,373,285, 5,373,284, and 5,168,265, each of which is incorporated herein by reference. This preferred circuit is now described in greater detail.

Integrated circuit U1 acts as a quasi-regulated voltage source, and provides a regulated −3 volts on circuit terminal E2 (−V) and an unregulated, approximately 9 volts on circuit terminal E1 (+V). Battery B1, which is preferably a 12 volt miniature battery, is coupled across terminals E1 and E2. Diode CR1 acts as a zener diode in a starved condition and provides approximately 3 volts as a reference voltage for integrated circuit U1. Potentiometer R28 provides an adjustment of the regulated −3 volts.

Integrated circuit U4 acts as a comparator. It triggers on a positive going pulse from integrated circuit U3, as will be explained, and latches up through hysteresis (i.e., feedback resistor R7) to cause LED CR3 (which is the visual alarm LED 8) to remain illuminated. The output of circuit U4 is coupled to the base of driver transistor Q1, whose emitter is coupled to LED CR3. LED CR3 is powered by an auxiliary 3 volt battery (or, as shown in FIG. 18, the series interconnection of two 1.5 volt batteries B2 and B3).

Separate 12 volt and 3 volt batteries are used in the monitor to provide a fail-safe measure. Since the LED CR3 draws the most current, that is, approximately 500 milliamps, if the LED fails due to a low battery, the rest of the circuit which is powered by the 12 volt battery B1 continues to operate to provide a warning to the user that high RF energy is present. Since the exposure light 8 (ex. batteries, the LED CR3) is powered from a separate battery (i.e., B2 and B3), maximum life is provided for the battery which powers the audible alarm 6. The battery B1 for the audible alarm is envisioned to last approximately 30 days in a "sleep" mode and 6 hours in a continuous alarm state. The exposure light 8 will last approximately 100 hours in a continuous lighted state.

Integrated circuit U2 is an operational amplifier configured as a conditioning amplifier with a gain of approximately 1,000. Potentiometer R27 is provided as a gain adjustment. The amplifier amplifies the signal from the radiation sensor 100 which is coupled to circuit terminals E7 and E8, and amplifies that signal before providing it to integrated circuit U3. Terminal E7 is connected to the resistive lead of the flexible transmission line 44. Terminal E8 is ground and is connected to a ground lead (not shown) in the flexible transmission line. Alternatively, the printed circuit board 110 on which the detector circuit is mounted may include a ground plane on its bottom surface, which contacts the ground shield 58 which is connected to the ground of the electronic circuit on the main printed circuit board 42 to effect a common ground between the detector circuit 66 and the electronic circuit on the main printed circuit board 42, thus eliminating the need for a separate ground lead in the flexible transmission line 44 and its connection to terminal E8.

Resistor R10, which is coupled to one leg of potentiometer R27, is a sensitor (i.e., a thermistor) and is provided to compensate for temperature variations so that conditioning amplifier U2 will provide more or less gain, as needed, as the temperature varies.

Integrated circuit U3 is a conventional circuit used in smoke detectors. Smoke detector circuit U3 provides a regulated voltage on its pin 1 which, in the case of the monitor circuit, is a 3 volt reference voltage to ground. Resistors R19 and R20 comprise a resistor network which preferably provides about a 1 volt alarm threshold on pin 2 of circuit U3. A standard piezo electric transducer 6 is coupled through terminals E4, E5 and E6 to pin numbers 8, 9 and 10 of circuit U3. As mentioned previously, a suitable transducer which may be used in Part No. PKM 11-6A0 manufactured by Murata-Erie Co. Capacitor C10, connected between Pin 3 of circuit U3 and ground, is provided to quiet bursts of noise that might set off the alarm.

Amplifier U2 has associated with it an auto-zero and temperature offset compensation circuit. The compensation circuit includes a pair of thermistors TH1, TH2 connected in a bridge configuration with bridge resistors R11, R12. The junction between thermistor TH2 and resistor R12 is provided with a negative voltage through resistor R14, and that junction and the junction of thermistor TH1 and resistor R11 are respectively coupled to the legs of potentiometer R26, whose wiper is connected to ground. The junctions between thermistor TH1 and resistor R12 and thermistor TH2 and resistor R11 are respectively connected to the opposite legs of potentiometer R25, whose wiper is coupled to the inverting input (Pin 2) of amplifier U2. Potentiometer R26 is adjusted at ambient temperature for zero voltage offset, and potentiometer R25 is adjusted for zero offset at the elevated temperature. Once adjusted, thermistors TH1, TH2 in the bridge configuration maintain the balanced temperature compensation. The bridge circuit is described in U.S. Pat. No. 4,605,905, which issued to the inventor on Aug. 12, 1986, the disclosure of which is incorporated herein by reference.

The circuit of the radiation monitor of the present invention operates in the following manner. The radiation sensor 40 generates preferably greater than 1 millivolt per 1 milliwatt per square centimeter of RF energy which illuminates it. This signal is carried by the transmission line 44 described previously to the inputs of conditioning amplifier U2. Amplifier U2 amplifies the signal from the radiation sensor (that is, when the sensor is illuminated with 1 milliwatt per square centimeter of energy) by preferably 1,000 to provide an output signal which is preferably greater than 1 volt. This signal is provided to pin 3 of the smoke detector circuit U3. If the amplified signal from conditioning amplifier U2 is greater than the 1 volt threshold on pin 2 of circuit U3, the output of circuit U3 at pin 12 will provide a positive going pulse through diode CR2 to the non-inverting input (pin 3) of comparator U4.

In response to this pulse, the output of comparator U4, at pin 6, will go to a positive voltage and bias transistor Q1 on. Transistor Q1 will conduct current through LED CR3 to illuminate the LED of the radiation monitor. Hysteresis will keep comparator U4 latched until the circuit is reset.

Also, smoke detector circuit U3 sounds the piezo electric alarm 6 (FIG. 18) when the threshold is exceeded. Circuit U3 further monitors the battery voltage. When the battery voltage drops to approximately 7.5 volts, circuit U3 will cause the alarm to emit a chirp every 40 seconds. If the battery B1 drops further in voltage, the chirps emitted by the alarm 6 will become more frequent until a battery voltage is reached which causes the alarm to emit a continuous warble tone.

The monitor of the present invention further provides a self-test upon turn on. Capacitor C2, which is connected between the input (pin 3) of the conditioning amplifier U2 and the regulated 3 volt output of circuit U3 (at pin 1), is initially uncharged, thus providing a test voltage to be applied to the input (pin 3) of conditioning amplifier U2. Capacitor C2 is coupled to resistor R17 to ground to allow capacitor C2 to charge. This test voltage simulates the output signal generated by the detector circuit 66 when the sensor is illuminated with RF energy. The test voltage is amplified by circuit U2, and smoke detector circuit U3 sounds the alarm and causes comparator U4 to go to a positive state on its output, thereby turning on transistor Q1 and illuminating LED CR3. Comparator U4 is not latched under these test conditions. This is because capacitor C8, which is coupled between the regulated −3 volts and the positive supply voltage input (pin 7) of comparator U4 and one side of resistor R8 whose other side is connected to the unregulated 9 volt supply, is initially uncharged. Capacitor C8 prevents the positive supply voltage from being supplied to pin 7 of comparator U4. Circuit U4 will not latch up through hysteresis feedback resistor R7 under these conditions until capacitor C8 has become charged. At that time, however, capacitor C2 has become fully charged and effectively removes the test voltage from the input of conditioning amplifier U2. The output of amplifier U2 thereby falls below the 1 volt threshold, and the output signal from circuit U3 returns to a low level. This, in turn, causes the output signal of comparator U4 to return to a low logic level, thereby cutting off transistor Q1 and turning off warning LED CR3.

To ensure that the various capacitors and other components in the electronic circuitry of the monitor are fully discharged when the monitor is shut off, which thereby prevents false alarms as well as prevents comparator U4 from latching, a single pole, double throw switch is used as the on/off switch S1, as shown in FIG. 18. The positive side of battery B1 is coupled to one pole (S1-1) of the switch. The wiper terminal (S1-2) of the switch is coupled to the E1 terminal of the electronic circuit board. The E2 terminal is connected directly to the negative terminal of the battery and to the other pole (S1-3) of the switch. Accordingly, when the switch S1 is in the on position, wiper S1-2 contacts pole S1-1 to provide voltage from battery B1 across terminals E1 and E2.

The audible alarm 6, which may be a piezo ceramic horn, includes three leads, illustrated as blue, red and black, which are respectively connected to terminals E5, E4 and E6. The series interconnection of batteries B2 and B3 has its overall positive side connected to terminal E9 and its negative side connected to terminal E10.

When the switch is in the off position, wiper S1-2 contacts the opposite pole S1-3 and provides a short circuit across terminals E1 and E2. Because transistor Q1 remains cut off, when LED CR3 is not illuminated, negligible current is drawn from batteries B2 and B3 when the monitor is off.

A parts list for the circuits shown in FIGS. 12 and 17 is provided below. Also, the pin numbers shown in FIG. 17 for integrated circuits U1–U4 related to the parts specified in the list although, of course, it is envisioned that components comparable to those listed below, connected differently from that shown in FIG. 17, may be suitable for use.

| Part Description | Reference Designation |
|---|---|
| PARTS LIST FOR CIRCUIT SHOWN IN FIG. 12 | |
| RESISTOR 68 OHMS | R1 |
| RESISTOR 150 OHMS | R2 |
| RESISTOR 18 OHMS | R3 |
| INDUCTOR .22 uH | L1 |
| CAPACITOR 1000 pF | C1 |
| CAPACITOR 68 pF | C2 |
| CAPACITOR 51 pF | C3 |
| DIODE SCHOTTKY | CR1 |
| PARTS LIST FOR CIRCUIT SHOWN IN FIG. 17 | |
| TRANSISTOR 2N4124 | Q1 |
| WIRE, BUSS | W1 |
| CAPACITOR .33 uf | C10 |
| CAPACITOR 22 uf | C7–8 |
| CAPACITOR .1 uf | C2, C3, C6 |
| CAPACITOR .01 uf | C4, C5 |
| CAPACITOR .001 uf | C1 |
| LIGHT EMITTING DIODE | CR3 |
| DIODE, 1N6263 | CR2 |
| ZENER DIODE, 1N4733 | CR1 |
| IC CHIP - CA3169A | U3 |
| IC CHIP - CA3078 | U1, U4 |
| IC CHIP - OP22EZ | U2 |
| CAPACITOR 1 uf | C9 |
| POTENTIOMETER 1 MEG OHMS | R27, R28 |
| POTENTIOMETER 10K OHMS | R26 |
| POTENTIOMETER 25K OHMS | R25 |
| RESISTOR 2.4K OHMS | R32 |
| RESISTOR 360K OHMS | R9 |
| RESISTOR 62 OHMS | R23 |
| RESISTOR 3 MEG OHMS | R22 |
| RESISTOR 200K OHMS | R8 |
| RESISTOR 20 MEG OHMS | R31 |
| RESISTOR 100K OHMS | R9 |
| RESISTOR 510K OHMS | R14—14, R20 |
| RESISTOR 10K OHMS | R11, R12 |
| SENSITOR 3.3K OHMS | R10 |
| RESISTOR 2 MEG OHMS | R7, 17 |
| RESISTOR 3.3 MEG OHMS | R6 |
| RESISTOR 5.1 MEG OHMS | R21 |
| RESISTOR 820K OHMS | R2, R5 |
| RESISTOR 1 MEG OHMS | R1, 3, 4, 19, 29 |
| RESISTOR 56K OHMS | R24 |
| RESISTOR 51K OHMS | R30 |
| THERMISTOR, 10K OHMS | TH1, TH2 |

The radiation monitor of the present invention accurately detects RF radiation by using body scattering caused by the wearer's body to create a secondary radial electric field component, which is detected by the particular shape of the surface area sensor. The response of the sensor assembly 40 is proportional to the magnitude of the electric field and relatively independent of frequency.

Also, the radiation monitor is effective over a wide range of frequencies in the lower RF spectrum, that is, from about 100 KHz to about 300 MHz, which substantially encompasses the AM and FM broadcast bands both in the United States and in Europe. The monitor provides accurate monitoring of electromagnetic radiation in these frequencies by measuring the radial component of the electric field.

The compact size of the radiation monitor allows it to be worn on a belt using the clip 10 (FIG. 2) provided or in the wearer's pocket. Its broadband frequency performance and independence of polarization make the monitor perfectly adaptable for use in a variety of RF environments. The audible alarm 6 provides a warning of RF exposure, and the LED 8 provides a visual indication as well. The LED latches so as to provide a record that the wearer was exposed to RF energy, in the event the wearer did not hear the audible alarm before he left the danger zone.

The personal electromagnetic radiation monitor of the present invention is further quite suitable for use in high ambient noise environments. The earplug assembly 22 includes earplugs 32 which may be used in conjunction with ear phones, and is non-electrically conductive to prevent injury to the wearer and misreadings or damage to the electronic circuitry of the monitor. The detent and protrusion type connection used on the earplug assembly and the housing of the monitor allows the user to quickly and easily connect the earplug assembly 22 to the transducer 6 on the housing with no electrical connection required.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. A personal electromagnetic radiation monitor wearable by a person to a warn the person of a radiation hazard condition caused by electromagnetic radiation emanating from a source of electromagnetic radiation, the electromagnetic radiation radiated by the source having at least a primary radial electric field component and a vertical or horizontal electric field component disposed perpendicularly to the radial electric field component, the vertical or horizontal field component inducing a flow of a displacement current in the person's body, the displacement current generating a secondary radial electric field component emanating from the person's body, the personal electromagnetic radiation monitor comprising:

an electromagnetic radiation sensor, the electromagnetic radiation sensor being capable of sensing the primary radial electric field component directly emanating from the source of electromagnetic radiation and the secondary radial electric field component emanating from the person's body, the electromagnetic radiation sensor generating an output signal in response to the primary and secondary radial electric field components sensed by the electromagnetic radiation sensor;

a detector, the detector being responsive to the output signal from the electromagnetic radiation sensor and generating a detected signal in response thereto;

means responsive to the detected signal for comparing a threshold signal with one of the detected signal and a signal corresponding thereto, the comparing means generating an output signal in response to the comparison thereof; and an alarm circuit, the alarm circuit being responsive to the output signal of the comparing means and generating an alarm signal in response thereto.

2. A personal electromagnetic radiation monitor as defined by claim 1, wherein the electromagnetic radiation sensor includes a surface area sensor, the surface area sensor having a planar shape.

3. A personal electromagnetic radiation monitor as defined by claim 2, wherein the surface area sensor includes a flat conductive member.

4. A personal electromagnetic radiation monitor as defined by claim 3, wherein the surface area sensor further includes a resistive film adjacent to at least one surface of the flat conductive member.

5. A personal electromagnetic radiation monitor as defined by claim 1, wherein the electromagnetic radiation sensor includes a surface area sensor, the surface area sensor having a three-dimensional shape to sense radial and vertical or horizontal electric field components of the electromagnetic radiation.

6. A personal electromagnetic radiation monitor as defined by claim 5, wherein the surface area sensor is can-shaped and includes an at least partially conductive disk and an at least partially conductive sidewall extending perpendicularly from the disk.

7. A personal electromagnetic radiation monitor as defined by claim 5, wherein the surface area sensor at least partially defines an interior space; and wherein the detector is mounted within the interior space of the surface area sensor.

8. A method of determining a radiation hazard condition for a person exposed to electromagnetic radiation emanating from a source of electromagnetic radiation, the electromagnetic radiation radiated by the source having at least a primary radial electric field component and a vertical or horizontal electric field component disposed perpendicularly to the primary radial electric field component, the vertical or horizontal field component inducing the flow of a displacement current in the person's body, the displacement current generating a secondary radial electric field component emanating from the person's body, the method comprising the steps of:

sensing the primary radial electric field component directly emanating from the source of electromagnetic radiation;

sensing the secondary radial electric field component emanating from the person's body;

generating an output signal in response to the primary and secondary radial electric field components sensed;

detecting the output signal and generating a detected signal in response thereto;

comparing a threshold signal with one of the detected signal and a signal corresponding thereto and generating a comparison output signal in response to the comparison thereof; and selectively generating an alarm signal in response to the comparison signal.

9. A method of determining a hazard condition for a person exposed to electromagnetic radiation emanating from a source of electromagnetic radiation, the electromagnetic radiation radiated by the source of electromagnetic radiation comprising a primary radial electric field component and a vertical or horizontal electric field component, which comprises the steps of:

sensing the primary radial electric field component directly emanating from the source of electromagnetic radiation;

sensing a secondary radial electric field component emanating from the body of a person exposed to the electromagnetic radiation, the vertical or horizontal electric field component of the electromagnetic radiation generating the flow of a displacement current in the person exposed to electromagnetic radiation, the displacement current generating the secondary radial electric field component emanating from the person's body; and selectively triggering an alarm to alert the person of a hazard condition in response to the primary and secondary electric field components sensed.

10. An electromagnetic radiation sensor for use in a personal electromagnetic radiation monitor wearable by a person to warn the person of a radiation hazard condition caused by electromagnetic radiation emanating from a source of electromagnetic radiation, the electromagnetic radiation radiated by the source having at least a primary radial electric field component and a vertical or horizontal electric field component disposed perpendicularly to the radial electric field component, the vertical or horizontal field component inducing a flow of a displacement current in the person's body, the displacement current generating a secondary radial electric field component emanating from the person's body, the electromagnetic radiation sensor comprising:

a surface area sensor, the surface area sensor having one of a planar and a three dimensional shape, the surface area sensor being capable of sensing the primary radial electric field component directly emanating from the source of electromagnetic radiation and the secondary radial electric field component emanating from the person's body, the electromagnetic radiation sensor generating an output signal in response to the primary and secondary radial electric field components sensed by the surface area sensor.

11. A personal electromagnetic radiation meter carried by a person to indicate to the person at least one of the strength of an electric field associated with electromagnetic radiation emanating from a source of electromagnetic radiation and the current induced in the person's body caused by the electromagnetic radiation, the electromagnetic radiation radiated by the source having at least a primary radial electric field component and a vertical or horizontal electric field component disposed perpendicularly to the radial electric field component, the vertical or horizontal field component inducing a flow of a displacement current in the person's body, the displacement current generating a secondary radial electric field component emanating from the person's body, the personal electromagnetic radiation monitor comprising:

an electromagnetic radiation sensor, the electromagnetic radiation sensor being capable of sensing the primary radial electric field component directly emanating from the source of electromagnetic radiation and the secondary radial electric field component emanating from the person's body, the electromagnetic radiation sensor generating an output signal in response to the primary and secondary radial electric field components sensed by the electromagnetic radiation sensor; and an indicator, the indicator being responsive to one of the output signal of the electromagnetic radiation sensor and a signal corresponding thereto and providing at least one of an indication of the electric field strength of the electromagnetic radiation in the area of the meter in response thereto and a measurement of the displacement current induced in the person's body caused by the electromagnetic radiation.

* * * * *